US011608820B2

(12) United States Patent
Ren et al.

(10) Patent No.: US 11,608,820 B2
(45) Date of Patent: Mar. 21, 2023

(54) BELT GUARD COMPRISING A COMPRESSOR SILENCER

(71) Applicant: QUINCY COMPRESSOR LLC

(72) Inventors: Tingrong Ren, Spanish Fort, AL (US); Steve Centers, Daphne, AL (US); Gerald Kalapos, Spanish Fort, AL (US); Byron Walker, Loxley, AL (US); Erik Baccin, Daphne, AL (US)

(73) Assignee: QUINCY COMPRESSOR LLC, Bay Minette, AL (US)

( * ) Notice: Subject to any disclaimer, the term of this patent is extended or adjusted under 35 U.S.C. 154(b) by 654 days.

(21) Appl. No.: 16/505,865

(22) Filed: Jul. 9, 2019

(65) Prior Publication Data

US 2020/0072207 A1 Mar. 5, 2020

Related U.S. Application Data

(60) Provisional application No. 62/723,698, filed on Aug. 28, 2018.

(51) Int. Cl.

| | |
|---|---|
| ***F04B 41/02*** | (2006.01) |
| ***F04B 39/00*** | (2006.01) |
| ***F04B 39/12*** | (2006.01) |
| ***F04B 39/16*** | (2006.01) |

(52) U.S. Cl.

CPC ..... *F04B 39/005* (2013.01); *F04B 39/0055* (2013.01); *F04B 39/121* (2013.01); *F04B 39/16* (2013.01); *F04B 41/02* (2013.01)

(58) Field of Classification Search

CPC . F01N 1/12; F01N 1/125; F01N 1/086; F04B 53/20; F04B 53/16; F04B 35/00; F04B 35/01; F04B 9/02; F04B 39/0027–0088; F04B 39/16; F04B 39/12–121; F04B 39/123; F04C 29/0092; F04C 29/06–068; F04D 29/663–665; F04D 29/70–701; F02M 35/12–1288; F02M 35/14; B04C 3/00; B04C 3/04

See application file for complete search history.

(56) References Cited

U.S. PATENT DOCUMENTS 943,233 A * 12/1909 Boyle ..... F01N 1/12 181/279
1,601,137 A * 9/1926 Maxim ..... F01N 1/12 181/279

(Continued)

*Primary Examiner* — Thomas Fink
(74) *Attorney, Agent, or Firm* — Bacon & Thomas, PLLC

(57) ABSTRACT

A belt guard for an air compressor that includes an air compressor silencer. The guard includes a housing that includes a front cover and a back cover, and an accommodation portion. The air compressor silencer is provided inside the housing in the accommodation portion, where the air compressor silencer includes a spirally shaped silencer core, and the spirally shaped silencer core includes at least one spiral chamber comprising a core inlet and a core outlet. Additionally, a compressor installation that includes a motor, a compressor, a belt connected to a compressor shaft of the compressor element and a motor shaft of the motor, and a belt guard that includes a front cover and a back cover, and an accommodation portion, where the compressor silencer is provided inside the housing in the accommodation portion.

21 Claims, 4 Drawing Sheets

(56) References Cited

U.S. PATENT DOCUMENTS

| | | | | |
|---|---|---|---|---|
| 3,927,731 | A * | 12/1975 | Lancaster | F01N 1/125 181/256 |
| 5,178,760 | A | 1/1993 | Solberg | |
| 6,045,599 | A | 4/2000 | Solberg | |
| 6,494,057 | B1 * | 12/2002 | Schuster | F25B 43/006 62/503 |
| 7,674,307 | B2 | 3/2010 | Solberg | |
| 2002/0048521 | A1 * | 4/2002 | Achtelik | F04C 29/0092 418/104 |
| 2002/0104502 | A1 * | 8/2002 | Tsubouchi | F02M 35/10275 123/184.57 |
| 2007/0205046 | A1 * | 9/2007 | Newberry | F01N 1/083 181/270 |
| 2010/0006371 | A1 * | 1/2010 | Link | F04B 39/0027 181/269 |
| 2010/0126796 | A1 * | 5/2010 | Kadowaki | B32B 15/18 181/207 |
| 2018/0073495 | A1 * | 3/2018 | White | F04B 35/04 |

* cited by examiner

BELT GUARD COMPRISING A COMPRESSOR SILENCER

CROSS REFERENCE OF RELATED APPLICATIONS

This application claims priority to provisional application No. 62/723,698, filed Aug. 28, 2018, which is incorporated herein by reference.

FIELD OF THE INVENTION

The present invention relates generally to a compressor installation which includes a belt guard that comprises a compressor silencer for reducing the noise emitted from certain compressors, especially reciprocating piston air compressors.

BACKGROUND OF THE INVENTION

Compressor installations may include a motor, a gas compressor driven by the motor, and a storage tank to store gas that has been compressed by the gas compressor. The motor may be an electric motor, an internal combustion engine, or another type of motor. The gas may be air or another gas. The compressor may be a reciprocating piston compressor, a centrifugal compressor, a scroll compressor, a screw compressor having male and female compressor elements, or another type of compressor. The storage tank may be a canister, reservoir, or other type of tank, that contains the compressed gas until it is used to power a device such as a tool, or used by an end user, or released to atmosphere. In most cases, air is drawn into an inlet air side of the gas compressor from the atmosphere, and then mechanically compressed, e.g., via pistons or male and female rotors, into a smaller volume in the compression chamber of the gas compressor. The compressed gas flows through a pipe or the like, to the storage tank. During the compression process, due to the large volume of air provided through the air inlet of the compressor, noise is generated at the air inlet or suction side.

In a reciprocating compressor, which is widely used in various industrial and domestic applications, the reciprocating compressor and motor with belt drive can be mounted on a tank. The motor is used to drive the belt in a pulley system to rotate a crankshaft that moves the piston(s) in a reciprocating manner, where gas enters the suction side, typically through an inlet manifold, is compressed via the piston(s) being driven in a reciprocating manner, and then discharged at high pressure into a tank.

However, during operation of the reciprocating compressor, noise is emitted from the air inlet or suction side of the reciprocating compressor when the air is drawn through the inlet manifold, e.g., due to the turbulence of the air moved through the inlet. Typically, the prior art reciprocating compressor has little to no provisions to reduce the noise it generates or employs conventional structures to reduce this noise. For example, one conventional structure draws the inlet air through a large, bulky, and remotely mounted baffling box, where such structure is costly and restricts the inlet air flow by employing a long tube that connects the suction side or air inlet of the compressor to the large baffling box, which reduces the efficiency of the compressor.

In view of such drawbacks, there is a need to provide a simpler, smaller, and more cost-effective structure for reducing the noise generated at the air inlet of compressors that does not reduce the efficiency of the compressor.

SUMMARY OF THE INVENTION

The present invention is provided to solve the deficiencies of the prior art by providing improvements over the prior art. It is an object of the present invention to provide a belt guard that includes an compressor silencer that costs less, is much smaller, and can be attached directly to the compressor inlet to reduce or eliminate restriction to the inlet gas flow. The gas is typically air.

In one embodiment of the invention, since a belt guard is required on all belt driven units, an air compressor silencer is provided inside the belt guard, which can then be attached directly to the air inlet of a compressor. The air compressor silencer is configured to reduce and/or eliminate the noise at the air inlet (drawn through the belt guard) to provide a quieter compressor without adding significant extra costs and without significantly reducing efficiency. In one embodiment of the invention, the air compressor silencer comprises a spirally shaped silencer core, where the spirally shaped silencer core comprises at least one spiral chamber having a core inlet and a core outlet.

In another embodiment of the invention, the spiral chamber comprises hollow walls forming the spiral chamber, where the hollow walls comprise sound absorbing material along an inside and/or along an outside wall of the spiral chamber. The spiral chamber can be made of metal, plastic, a composite material, or a combination thereof and/or include material to dampen the noise.

In order to reduce costs and size, the air compressor silencer is incorporated into the belt guard to eliminate the need for a separate housing for the air compressor silencer and/or the inlet air filter. A tube, e.g., short tubing, can then be used to connect the air compressor silencer to the compressor intake/air inlet.

In yet another embodiment of the invention, a compressor installation comprises a motor for driving a compressor element, a compressor element to compress a gas, a belt connected to the compressor shaft of the compressor element and a motor shaft of the motor, e.g., mechanically coupling the motor to the compressor element, and a belt guard comprising a housing configured to house the belt. The belt guard comprises a front cover, a back cover, and an air compressor silencer. The front cover includes an accommodation portion. The air compressor silencer is provided inside the housing in the accommodation portion. The air compressor silencer comprises a spirally shaped silencer core and the spirally shaped silencer sore comprises at least one spiral chamber comprising a core inlet and a core outlet.

BRIEF DESCRIPTION OF THE DRAWINGS

The features and objects of the present invention are more clearly understood from the detailed description taken in conjunction with the accompanying drawings, in which.

Figure 1:
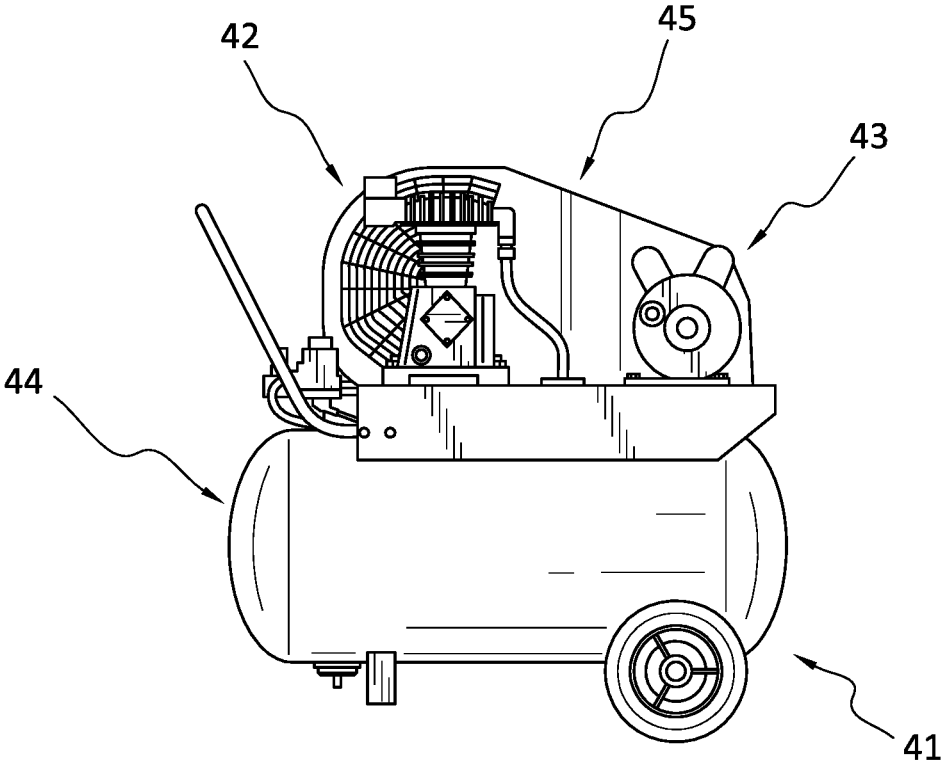
FIG. 1 PRIOR ART
FIG. 1 illustrates a perspective view of a prior art compressor installation with a compressor and motor mounted on a tank.

In the various figures, similar elements are provided with similar reference numbers. It should be noted that the drawing figures are not necessarily drawn to scale, or proportion, but instead are drawn to provide a better understanding of the components thereof, and are not intended to be limiting in scope, but rather provide exemplary illustrations.

DETAILED DESCRIPTION OF THE INVENTION

The present invention will be described with respect to particular embodiments and with reference to certain drawings but the invention is not limited thereto and can be combined interchangeably with certain features in the different embodiments.

FIG. 1 illustrates a prior art compressor installation 41 comprising a compressor 42 and a motor 43 mounted on a tank 44, and provided with a belt guard 45. In the prior art, the compressor may be a single or two stage reciprocating compressor or piston compressor, a centrifugal compressor, a scroll compressor, a screw compressor having male and female compressor elements, or the like. In this embodiment, the compressor 42 is illustrated as a reciprocating compressor having a piston cylinder. The compressor 42 is driven by a motor 43 through the pulley within belt guard 45. The motor rotates the crankshaft to reciprocate the piston(s) to compress the air in the piston cylinder(s) of the compressor. The compressed air is then discharged from the compressor 42 to be stored in a tank 44, or distributed to users.

Figure 2A:
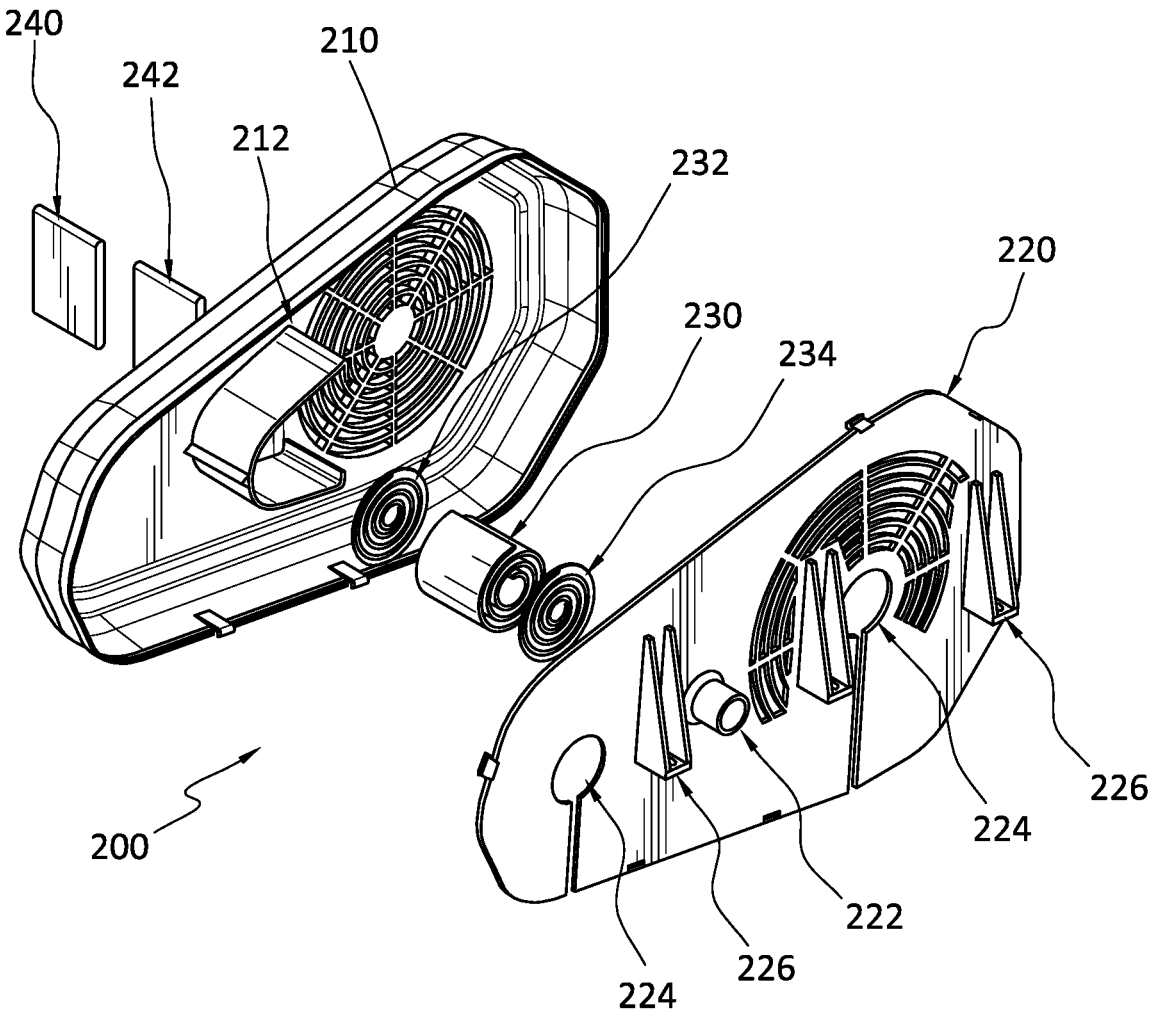
FIGS. 2A-2B illustrate exploded perspective views of a belt guard having a compressor silencer according to an embodiment of the present invention.
Figure 2B:
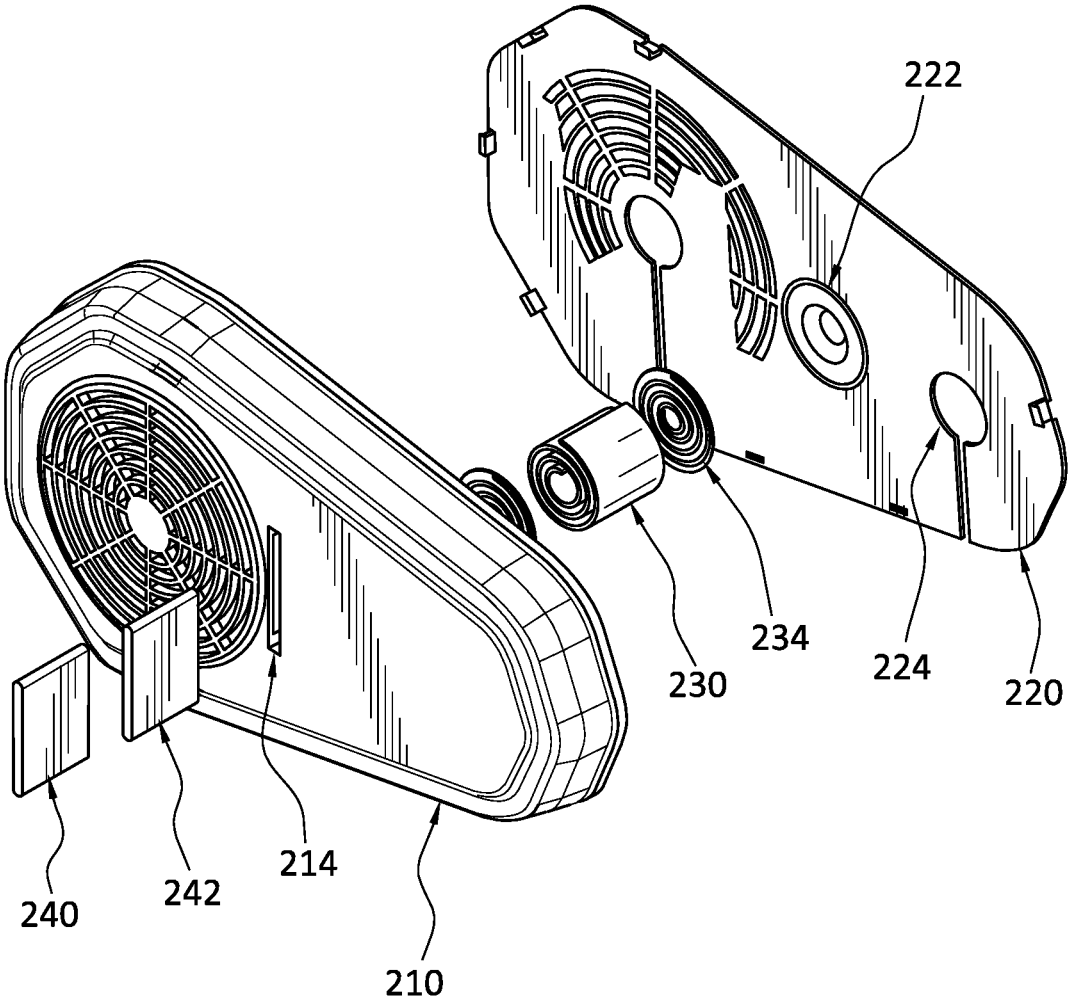

FIGS. 2A-2B illustrate an embodiment of the present invention where belt guard 200 is provided around the belt 210, which mechanically couples a compressor shaft of the compressor 42 and a motor shaft of the motor 43, so that the motor can be used to reciprocate the piston(s) in the compressor 42. One of the benefits of the belt guard 200 of the present invention is that the belt guard 200 includes a compressor silencer and includes a connection portion, e.g., a fitting, piping or tubing, that connects the belt guard 200 to the inlet of the compressor 42 to reduce and/or eliminate the noise generated when the gas, typically air, is suctioned or drawn into the compressor through the belt guard. For many existing air compressor installations, the belt guard 200 of the present invention with the noise reducing function can be used to replace the standard air filters used for reciprocating air compressors at the air inlet by further including air filter media in the belt guard, or the belt guard 200 can be attached to standard air filters, e.g., series connection via piping or tubing.

As illustrated in FIGS. 2A-2B, in one embodiment of the invention, the belt guard 200 includes a housing comprising a front cover 210 and a back cover 220, where the front cover 210 includes an accommodation portion 212 and a slot 214. The slot 214 is adapted to receive removable filter screen 240 and removable filter 242. The back cover 220 includes a connection portion 222 for coupling to the air inlet of the compressor, e.g., via a fitting, tubing or piping by screw fittings, welding, pinned connection, cam fittings, compression fitting, etc. The back cover 220 also includes vertical slots 224 which allow the belt guard 200 to slide onto the compressor shaft and the motor shaft for installation, where the compressor and motor do not have to be moved for the assembly. Additionally, the back cover 220 includes mounting portions 226 which are attachable to brackets on a mounting plate that is attached to the compressor and motor. The front cover 210 and back cover 220 further include indentations and matching slots for connecting the front cover 210 to the back cover 220.

An air compressor silencer 230 is provided inside the housing in the accommodation portion 212. The air compressor silencer 230 comprises a spirally shaped silencer core, where the spirally shaped silencer core comprises at least one spiral chamber having a core inlet and a core outlet. The core outlet of the air compressor silencer 230 is configured to be coupled to the connection portion 222 of the back cover 220.

Specifically, the air compressor silencer 230 is provided in the accommodation portion 212 in a way such that air is drawn into a core inlet of the air compressor silencer 230 through an inlet side of the accommodation portion 212 and discharged through the core outlet to the air inlet of the compressor. For example, in one embodiment of the invention, a first end seal 232 abuts one end of the spiral chamber of the air compressor silencer 230 and a second end seal 234 abuts the second end of the spiral chamber of the air compressor silencer 230, where the first and second end seals are provided to seal the spirally shaped silencer core so that all of the air flow is forced through the spirally shaped silencer core. That is, the air flow is guided from the inlet side of the accommodation portion 212 through the core inlet of the spiral chamber and exits through the aperture in the center of the second end seal 234 and into the connection portion 222 of the back cover 220. The end seals 232, 234 are constructed of a composite material or rubber to seal the spiral chamber and direct the air flow through the air compressor silencer 230. While at least one spiral chamber is illustrated in this embodiment, a single spiral chamber or more than two spiral chambers can be used, where the number of spiral chambers are determined based on a number of factors, including the size of the compressor element and desired airflow amount.

A filtering element that comprises a filter screen 240 and a filter 242 can be provided at the inlet side of the accommodation portion 212 by being slid into the slot 214 of the front cover 210 to enclose the air compressor silencer 230 inside the accommodation portion 212, where the air flow is first filtered by the filter 242 before entering into the air compressor silencer 230. The filter screen 240 is provided as a supporting surface for the filter 242. The filter 242 can include a variety of filtering media for example, coalescing filters, particulate filters, and carbon filters, to remove at least solid particles, liquids, aerosols, hydrocarbon vapours, etc. The filtering element can be further configured to reduce high frequency noise, e.g., based on the material and construction of the filtering element, e.g., using noise reducing material such as composite material, and firmly mounting the filter screen with the accommodation portion, e.g., clips, screws, etc. The slot 214 of the front cover 210 allows the removal and servicing of the filter screen 240 and/or the filter 242 without having to remove the front cover 210 of the belt guard.

Figure 3A:
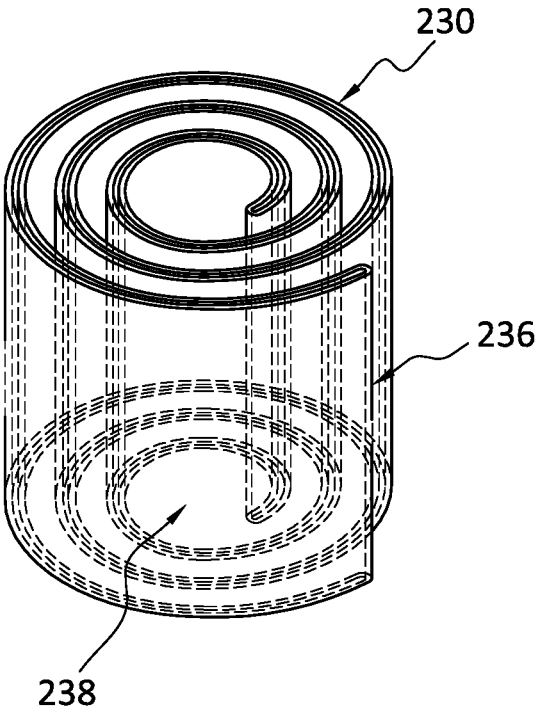
FIGS. 3A-3B illustrate a construction of the spiral chamber according to the present invention.
Figure 3B:
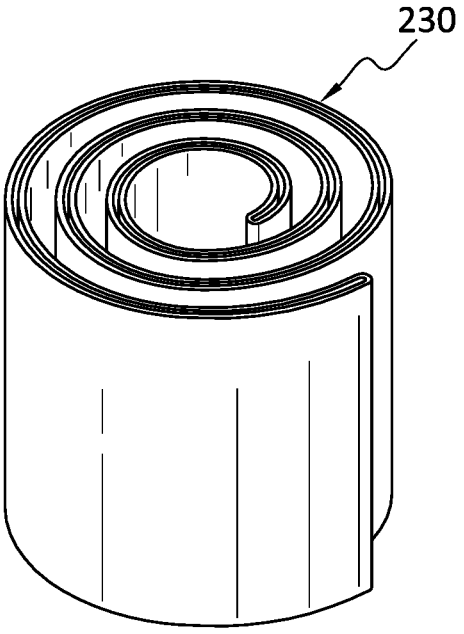

FIGS. 3A-3B, illustrate an air compressor silencer 230 according to the present invention which comprises a spirally shaped silencer core, where the spirally shaped silencer core comprises at least one spiral chamber. The at least one spiral chamber is provided with a core inlet 236 and a core outlet 238. The dimensions of the spiral chamber may be kept to a minimum, but the air compressor silencer 230 may be configured to reduce noise and provide an increased amount of air flow into the compressor, e.g., reduce the air flow restriction by having wider inlet openings. The windings of the spiral chamber preferably include two or three windings.

However, more or less windings are within the scope of the invention. The spiral shape of the spiral chamber prevents a straight path for the sound to travel, where the sound is instead reflected from all surfaces causing noise cancelation and attenuation. For example, the spiral windings provide a sealed surface for a broad spectrum of sound frequencies that are diffused or absorbed by the spiral chamber. The number of windings that are appropriate depends on the application and volume of air to be passed through the air compressor silencer 230. The air compressor silencer reduces air flow restriction to the compressor by not only providing a wider inlet opening, but reduces the noise by creating an extended and indirect path for the noise generated at the air inlet of the compressor to travel.

Furthermore, as shown in FIGS. 3A-3B, the at least one spiral chamber may be a double wall design, where the opening created in the hollow wall, e.g., between the double walls, can be provided with sound absorbing material in the inside wall and/or on the outside wall, e.g., between windings, to further reduce the noise generated when air is drawn through the compressor.

Noise reduction can be further enhanced by coating the spiral chamber with a sound absorbing material, such as sound proofing paint or gel, foam, fiberglass, ceramics or the like. This concept can be stacked for increased noise reduction. The end seals 232, 234 can also be coated with the sound absorbing material for further noise reduction.

The spirally shaped silencer core can be made of a composite material, such as plastic, rubber, metal, carbon, natural fibers, fiberglass, or a combination thereof, to absorb a broad spectrum of frequencies and can further include porous or corrugated tubes or foams inside the spirally shaped silencer core to further absorb noise.

Referring back to FIGS. 2A-2B, the operation of the belt guard 200 with noise reducing features is provided as follows: Air is drawn through the housing of the belt guard and through the filter 242 of the inlet side of the accommodation portion 212 toward the core inlet of the air compressor silencer 230. The first end seal 232 seals the air compressor silencer at one end so that air is drawn through the core inlet 236, which is provided as a lateral inlet along an outer surface of the spiral chamber. The air passes through the windings of the at least one spiral chamber and exits the spiral chamber centrally through core outlet 238 and centrally through the aperture in the center of the second end seal 234. Then, the air passes through the connection portion 222 of the back cover 220 through tubing or piping to the air inlet of the compressor.

Typically, in such compressor elements, noise is generated at the air inlet due to the suction of air, however, in the present invention, the noise from the suction of air is reduced and/or eliminated by the air compressor silencer 230 inside the belt guard 200. Without limiting the invention by theory, it is understood that the spiral chamber is configured to create an extended and indirect path for the sound to travel by forcing the air to travel through the several windings of the spiral chamber.

In view of such structure and features, the present invention solves the deficiencies of the prior art by providing a compact design in which a belt driven compressor includes a belt guard that includes an air compressor silencer which includes a spirally shaped silencer core that is configured to reduce and/or eliminate noise generated when air is drawn into a compressor. This is an improvement over the prior art in several ways. These features cost less than a baffle box provided at an air inlet of a compressor. The present invention allows a smaller size silencer due to the compact arrangement of the silencer inside the belt guard, and may be attached directly to the compressor air inlet to reduce or eliminate restriction to the inlet air flow. This design may further include a filter for filtering the inlet air, which further eliminates the need for an additional air filter on the air inlet of the compressor. The filter may be easily changed through the slot 214.

The invention discussed herein is directed to specific embodiments, but the design is not limited to the description of the exemplary invention but only by the scope of the appended claims. As a result, there are multiple embodiments that employ the beneficial characterises of the invention, each providing a different advantage and which are combinable and/or interchangeable with various aspects of the different embodiments of the invention that do not depart from the spirit and scope of the invention.

What is claimed is:

1. A belt guard for a compressor comprising:

a housing comprising a front cover and a back cover, and an accommodation portion defined by a wall disposed within said housing, the wall partially surrounding the accommodation portion and having an open inlet side;

a compressor silencer disposed within said accommodation portion, said compressor silencer comprising a spirally shaped silencer core, said spirally shaped silencer core comprising at least one spiral chamber comprising a core inlet and a core outlet; and a filter disposed to cover said open inlet side to enclose said compressor silencer within said accommodation portion;

wherein the back cover of the housing comprises a connecting element configured to connect the core outlet to an inlet of the compressor.

2. The belt guard for a compressor according to claim 1, wherein the compressor silencer further comprising end seals, wherein the end seals are provided to seal the spirally shaped silencer core.

3. The belt guard for a compressor according to claim 1, further comprising a filter screen configured in a way to support the filter.

4. The belt guard for a compressor according to claim 3, wherein the front cover of the housing includes a slot configured in a way such that the filter screen and the filter are able to be inserted at the open inlet side.

5. The belt guard for a compressor according to claim 1, wherein the at least one spiral chamber is coated with a sound absorbing material.

6. The belt guard for a compressor according to claim 1, wherein the at least one spiral chamber comprises at least two windings.

7. The belt guard for a compressor according to claim 1, wherein the at least one spiral chamber comprises hollow walls which form the spiral chamber and are filled with sound absorbing material.

8. The belt guard for a compressor according to claim 1, wherein the spirally shaped silencer core comprises composite material.

9. The belt guard for a compressor according to claim 2, wherein the end seals are provided at ends of the spirally shaped silencer core so that the core inlet of the at least one spiral chamber is provided as a lateral inlet along an outer surface of the at least one spiral chamber and the core outlet of the silencer core is provided centrally in the at least one spiral chamber.

10. A compressor installation comprising:

a motor;

a compressor;

a belt connected to a compressor shaft of the compressor and a motor shaft of the motor;

a belt guard comprising a housing configured to house the belt, said belt guard comprising a front cover, a back cover, and a compressor silencer within an accommodation portion defined by a wall disposed within said housing, the wall partially surrounding the accommodation portion and having an open inlet side; and a filter disposed to cover said open inlet side to enclose said compressor silencer within said accommodation portion;

wherein said compressor silencer comprises a spirally shaped silencer core, said spirally shaped silencer core comprising at least one spiral chamber comprising a core inlet and a core outlet, and wherein the back cover of the housing comprises a connecting element configured to connect the core outlet to an inlet of the compressor.

11. The silencer according to claim 1, wherein the spirally shaped silencer core is configured to reduce noise generated at the core inlet during operation.

12. The belt guard for a compressor according to claim 1, wherein the compressor is adapted to compress air.

13. The compressor installation according to claim 10, wherein the compressor is a reciprocating compressor for compressing air.

14. The compressor installation according to claim 10, wherein the at least one spiral chamber comprises hollow walls filled with sound absorbing material.

15. The compressor installation according to claim 10, further comprising a filtering element provided at an inlet of the accommodation portion.

16. The compressor installation according to claim 10, wherein the back cover comprises vertical slots, wherein said vertical slots are configured in a way such that the compressor shaft and the motor shaft are insertable into the vertical slots.

17. The compressor installation according to claim 10, wherein the back cover comprises mounting portions on a back surface of the back cover, said mounting portions configured to be attachable to brackets on a mounting plate to which the compressor element and the motor are attached.

18. The compressor installation according to claim 13, wherein the back cover comprises a connection portion configured to connect the core outlet to an air inlet of the compressor.

19. A method of installing a compressor silencer on an air compressor that is connected to a motor, comprising the following steps:

removing a first belt guard from the compressor and motor; and attaching a second belt guard to the compressor and motor, wherein said second belt guard comprises a housing comprising a front cover and a back cover, an accommodation portion defined by a wall disposed within said housing, the wall partially surrounding the accommodation portion and having an open inlet side, and a filter disposed to cover said open inlet side to enclose said compressor silencer within said accommodation portion; said accommodation portion comprising an air compressor silencer, said air compressor silencer provided inside the housing in the accommodation portion, said air compressor silencer comprising a spirally shaped silencer core, said spirally shaped silencer core comprising at least one spiral chamber comprising a core inlet and a core outlet; and wherein the back cover of the housing comprises a connecting element configured to connect the core outlet to an inlet of the compressor.

20. The compressor installation according to claim 10, wherein the silencer core is configured to reduce noise generated at a core inlet and reduce the air flow restriction to the compressor during operation.

21. The method according to claim 19, wherein the silencer core is configured to reduce noise generated at a core inlet and reduce the air flow restriction to the compressor during operation.

* * * * *